United States Patent [19]

Stahlecker

[11] Patent Number: 4,704,857

[45] Date of Patent: Nov. 10, 1987

[54] OPEN-END FRICTION SPINNING MACHINE PROVIDED WITH DEVICES FOR MONITORING FRICTION CHARACTERISTICS AND CONDITIONING SPINNING SURFACES

[75] Inventor: Fritz Stahlecker, Josef-Neidhart-Strasse 18, 7347 Bad Überkingen, Fed. Rep. of Germany

[73] Assignees: Hans Stahlecker; Fritz Stahlecker, both of Fed. Rep. of Germany

[21] Appl. No.: 16,986

[22] Filed: Feb. 19, 1987

Related U.S. Application Data

[63] Continuation of Ser. No. 761,685, Aug. 2, 1985, abandoned.

[30] Foreign Application Priority Data

Aug. 2, 1984 [DE] Fed. Rep. of Germany ..... 3428509

[51] Int. Cl.[4] ..... D01H 7/885; D01H 11/00

[52] U.S. Cl. ..... 57/264; 57/301; 57/401

[58] Field of Search ..... 57/264, 263, 300, 301, 57/400, 401, 406; 73/150 A, 9

[56] References Cited

U.S. PATENT DOCUMENTS

| | | | |
|---|---|---|---|
| 2,017,425 | 10/1935 | Wheeler | 73/9 |
| 2,821,081 | 1/1958 | Staples | 73/9 X |
| 3,950,930 | 4/1976 | Shindo et al. | 57/264 |
| 4,294,111 | 10/1981 | Rutledge et al. | 73/150 A X |

FOREIGN PATENT DOCUMENTS

| | | | |
|---|---|---|---|
| 109236 | 5/1984 | European Pat. Off. | 57/401 |
| 2944219 | 7/1980 | Fed. Rep. of Germany | 57/264 |
| 333659 | 4/1985 | Fed. Rep. of Germany . | |

*Primary Examiner*—John M. Jillions
*Assistant Examiner*—Joseph J. Hail, III
*Attorney, Agent, or Firm*—Barnes & Thornburg

[57] ABSTRACT

An open-end friction spinning machine having a plurality of adjacently arranged spinning units is provided with one or more devices for conditioning the outer cylindrical surfaces of at least one roller of a roller pair contained in each spinning unit. Additionally, the spinning units are provided with one or more devices to monitor the friction characteristics of at least one of these rollers exhibiting a closed cover surface. The conditioning device is constructed so as to be responsive to a friction characteristic monitored by the friction characteristic monitoring device.

21 Claims, 6 Drawing Figures

Fig. 1
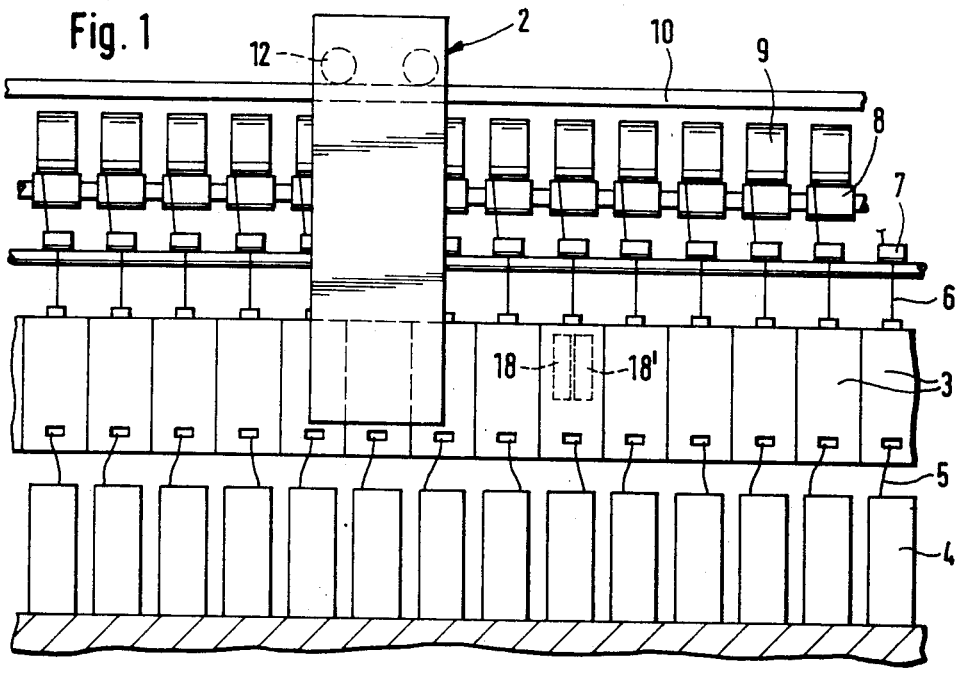
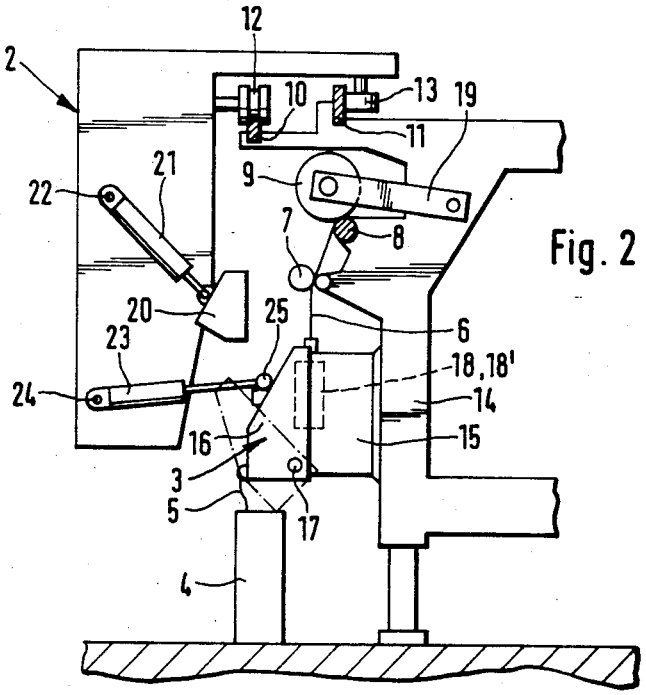
Fig. 2

OPEN-END FRICTION SPINNING MACHINE PROVIDED WITH DEVICES FOR MONITORING FRICTION CHARACTERISTICS AND CONDITIONING SPINNING SURFACES

This is a continuation of application Ser. No. 761,685 filed Aug. 2, 1985, now abandoned.

BACKGROUND AND SUMMARY OF THE INVENTION

The invention relates generally to an open end friction spinning machine with a plurality of adjacently arranged yarn formation zones or positions, each of which respectively includes two adjacently arranged rollers driven in the same direction forming a wedge shaped gap. At least one roller, the roller rotating outwardly from the wedge shaped gap, exhibits a continuous or closed cover surface. For conditioning the outer surface of the rollers with closed cover surfaces, there are one or more devices provided, as disclosed in German Patent Application No. P33 36 591.1.

In the above-mentioned disclosure, it is proposed that the spinning conditions and therewith the quality of the spun yarn are maintained constant through the conditioning of the roller with the closed cover surface so as to assure uniform friction characteristics.

One objective of the present invention is to further improve the maintenance of the friction cnaracteristics of the roller, especially rollers with closed cover surfaces, in a constant condition.

This objective is achieved according to the present invention by the provision of one or more devices for monitoring the friction characteristics of at least the rollers with closed cover surfaces.

With this arrangement it is possible to determine the appropriate point in time for conditioning the rollers as necessitated by the actual spinning conditions and also to conduct or monitor conditioning of the rollers in accordance with the desired results.

If a continuous monitoring of the individual spinning positions is to be performed, it is provided in one embodiment of the invention that each spinning position is provided with a device to monitor the friction characteristics of at least the one roller exhibiting a closed covered surface. The devices for monitoring the friction characteristics are connected with a signal sending means for signalling when a respective spinning position is in need of service. Through this signal sending means, a movable servicing apparatus can be activated by means of which conditioning at the corresponding spinning position is carried out.

In order to reduce expenses for the open end friction spinning machine, it is provided, in especially advantageous arrangements of the invention, that the devices for monitoring the friction characteristics are components of a servicing device which is movable along the open end friction machine and adjustably arranged at individual spinning positions. It is advantageous in this arrangement if the servicing device is provided with the device or devices for conditioning. It is then possible, after predetermined time intervals, or on the basis of monitoring spun yarn quality, or after a thread break, to activate the servicing device. The servicing device first monitors the friction characteristics of the roller and thereafter carries out conditioning in dependence upon the measured friction characteristic of the roller.

In further aspects of the invention it is provided that the devices for monitoring the friction characteristics include a device for monitoring the roller which is adjustably movable against the closed cover surface of one roller of the roller pair at a spinning position. The monitoring device is connected with a measuring device for measuring the friction characteristics of the rollers. With the monitoring roller the friction effect of the corresponding roller is directly monitored. In order that this monitoring need not be carried out at too high a driving speed of the rollers, sucn as that which occurs in normal operations, it is provided, in especially advantageous arrangements, that the devices for monitoring the friction characteristics are arranged along with an auxiliary drive at the surface of the roller exhibiting the closed covered surface. The monitoring of the friction characteristics can then be carried out at a roller rotational speed which is suitable for the monitoring operation.

Although the invention has been described and illustrated in detail, it is to be clearly understood that the above is to be taken by way of illustration and example only and not by way of limitation. The spirit and scope of the invention are to be limited only by the terms of the appended claims.

BRIEF DESCRIPTION OF THE DRAWINGS

FIG. 1 shows a partial view of the servicing side of an open end friction spinning machine with a movable servicing device, constructed in accordance with the persent invention;

FIG. 2 is a sectional view through the open end friction spinning machine and the servicing device positioned at a spinning position or unit, of the FIG. 1 arrangement;

DETAILED DESCRIPTION OF THE DRAWINGS

Figure 3:
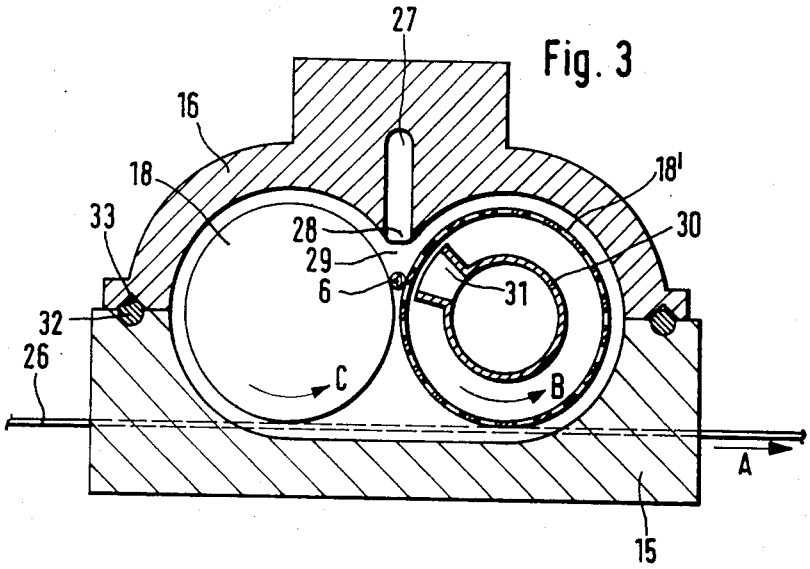
FIG. 3 is a sectional view through a spinning position in the region of the yarn formation zone of the rollers of the machine of FIG. 1.

The open end friction spinning machine according to FIGS. 1 to 3 exhibits a plurality of spinning units 3 arranged in a row adjacent one another, which respectively are fed from a can 4 with fiberband 5 to be spun. In the spinning unit 3, the fiberband 5 is spun into a yarn 6 which is drawn off by means of a withdrawal device 7 and is wound at a winding spool 9. The winding spool 9 is driven by a grooved drum 8 and is supported by a pivotal holder 19 (FIG. 2).

At a machine frame 14 bearing housings 15 are arranged for each spinning unit. In these bearing housings, bearing housing rollers 18 and 18' are accommodated. Friction surface means such as parallel adjacent rollers 18 and 18' define a yarn formation zone in the form of a wedge shaped gap 29 to which fibers are directed by means of fiber feed channel 27 from an inlet (not illustrated) and an opening device. The individual fibers are twisted together in the yarn formation zone 29 to form yarn 6 which is withdrawn in the longitudinal direction of the yarn formation zone 29 by the withdrawal device 7.

The rollers 18 and 18' are disposed (in a manner not further illustrated) in the bearing housing 15. They are driven in the same rotational direction (arrows B and C) by a tangential belt 26 (arrow A) which directly engages the outer surfaces of the rollers. This tangential belt 26 drives all of the rollers 18 and 18' at the spinning positions 3 of one of the sides of the machine in a corresponding manner.

The roller 18' which rotates inwardly into the wedge shaped gap 29 is constructed as a suction roller. It exhibits a perforated cover surface and each side is provided with a suction insert 30 which is connected with a vacuum pressure source. The suction insert 30 includes a pair of protrusions forming a suction slot 31 extending close to the inside surface of the roller 18. The suction slot is aimed at the wedge shaped gap 29 and adjacent to the mouth 28 of the fiber feed channel 27. A suction airstream is created from the fiber feed channel which holds incoming fibers as well as forming yarn 6 in the wedge shaped gap 29. Furthermore the fiber transport is supported through this suction airstream in the fiber feed channel 27.

The roller 18 which rotates outwardly from the wedge slot 29 (arrow C) exhibits a closed cover surface. It preferably has a steel cover which can be coated.

The rollers 18 and 18' are covered by means of a cover shaped housing part 16 at the servicing side of the yarn forming wedge shaped gap 29. The housing part 16 includes the fiber feed channel 27. This cover like housing part 16 is provided with longitudinal grooves 33 which center the housing part 16 on cylindrical ridges 32 which are arranged on the bearing housing 15.

Running wheels 12 and 13 of a servicing device 2 are disposed to move along the open end friction spinning machine glide tracks 10 and 11. The servicing device 2 includes the conditioning devices 20 for conditioning at least the roller 18, and friction monitoring devices 65 to monitor the friction characteristics of the rollers 18. The servicing device 2 is provided with a cover activity device 23 pivotable about a shaft 24. The device 23 is a hydraulic automatic press in the preferred illustrated embodiment. By means of a ball head 25 the device 23 is adjustable at a corresponding abutment piece of the cover shaped housing part 16. By means of the device 23 the housing part 16 is pivotably movable about shaft 17 to the illustrated dot/dash line position of FIG. 2. In this manner the rollers 18 and 18' are exposed. The servicing device 2, as already explained, is provided with the devices 20 and 65 to condition and monitor the outer surfaces, especially the closed cover surface exhibiting the roller 18. By means of a device 21 pivotable about shaft 22, conditioning and monitoring devices 20 and 65 are adjustable relative to the open spinning unit 3 and the rollers 18 and 18'. This pivotable device 21 is a pneumatic or hydraulic press in the preferred illustrated embodiment.

Figure 4:
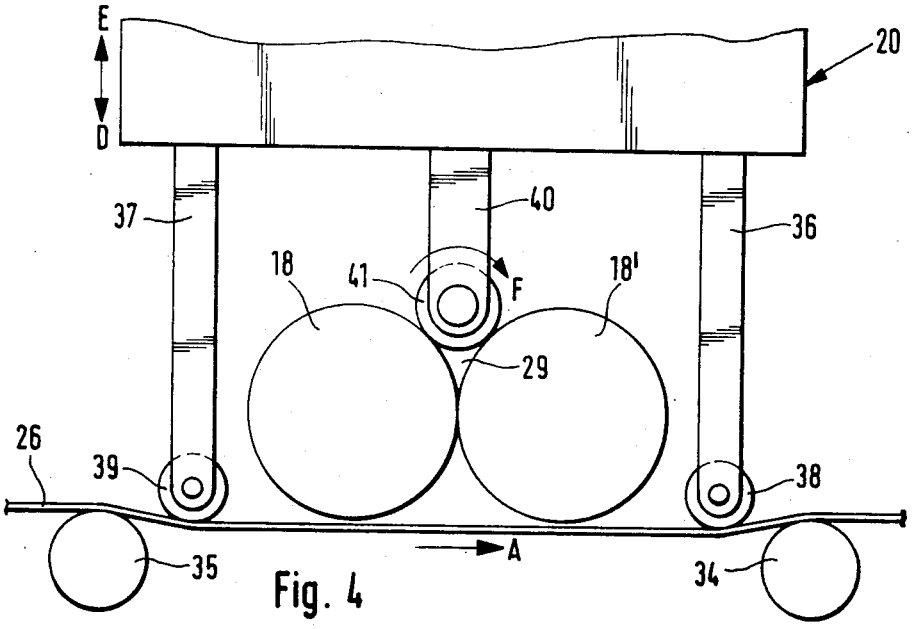
FIG. 4 is a schematic illustration of a device for disengaging the normal drive of the rollers at a spinning position and engaging an auxiliary drive for the rollers of the machine of FIG. 1.

In order to condition the entire circumference of the roller, especially roller 18, roller 18 must be rotated during the conditioning process. In order to condition at roller speeds below the relatively high normal driving speeds, conditioning device 20 is provided with means to disengage the normal drive means 26 and to selectively engage an auxiliary drive for the rollers 18 and 18' (see FIG. 4). The conditioning device 20, which is movable back and fortn (corresponding to the arrows D and E) with respect to the rollers 18 and 18', is provided with lift off rollers 38 and 39 disposed on arms 36 and 37. By means of rollers 38 and 39, the tangential belt 26 is lifted away from the rollers 18 and 18' in the direction of stationary rollers 34 and 35. Furthermore the conditioning device is provided with a driveable friction wheel 41 (arrow F) that is carried on an arm 40 and is adjustable between the two rollers 18 and 18' in the region of the wedge shaped gap 29. The driving direction F of the friction wheel 41 is selected so that the normal operating driving direction for the rollers 18 and 18' is also maintained by the auxiliary drive.

Figure 5:
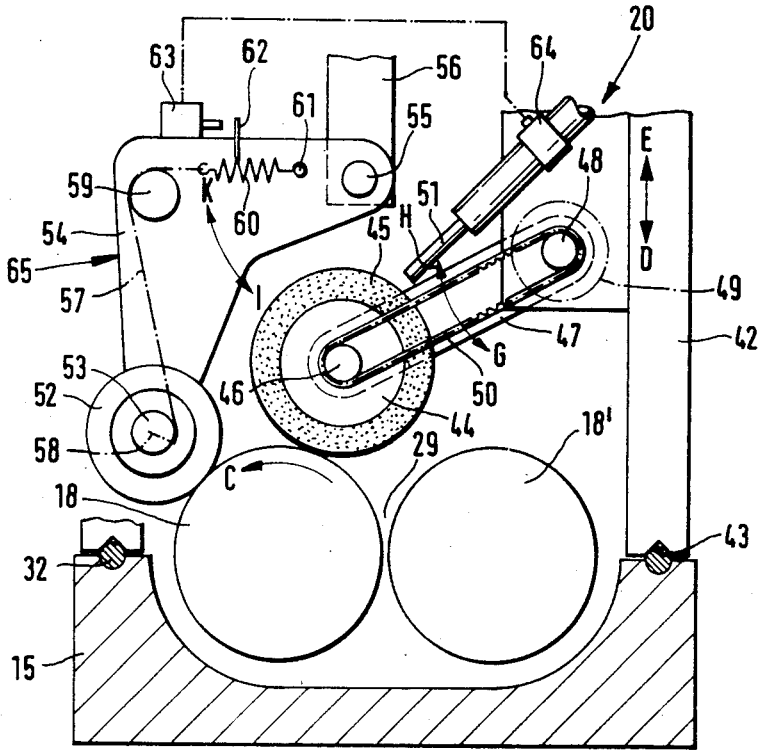
FIG. 5 is a scnematic part sectional view of a device for monitoring the friction characteristics of the one roller of a roller pair having a closed roller surface and a device for conditioning this roller operating at a spinning position constructed in accordance with preferred embodiments of the invention.

The conditioning device 20 is supported and centered by means of supports 42 arranged at the bearing housing 15 and provided with grooves 43 which are engagable with the cylindrical ridges 32 of the bearing housing 15. The conditioning device 20 moves itself corresponding to the direction of the arrows D and can be returned in the direction of the arrow E after the servicing process (FIG. 5).

The conditioning device 20 includes a transfer roller 44 which is provided with an absorbing coating 45 and which can abut against the outer surface of the roller 18. The transfer roller 44 is rotatably supported on shaft 46 which is in turn supported on a lever 47 which is pivotably movable in the direction of the arrows G and H. The lever 47 is pivotable about a shaft 48 of the device 20 by means of a driving mechanism (not illustrated). Coaxial to the shaft 48 of the lever 47 there is a motor 49 arranged which drives the shaft 46 of the transfer roller 44 with a toothed belt 50. The transfer roller 44 can drive the roller 18 so that the friction wheel 41 (FIG. 4) can be removed during the conditioning and also during the yet to be described monitoring of the friction characteristics of the roller 18.

A nozzle 51 is provided at device 20 adjacent the transfer roller 44 for coating roller 44. The absoroing coating 45 of the transfer roller 44 comprises a predetermined coating of material effective for the friction effect. The nozzle 51 can extend either over the entire working width of the transfer roller 44 or it can be movably arranged.

The servicing device 2 includes a friction characteristic monitoring device 65 for monitoring the friction characteristics of the roller 18. The monitoring device 65 includes a monitoring roller 52 which is rotatably supported on shaft 53 extending parallel to the roller 18. The monitoring roller 52 is arranged on pivotable holder 54. Holder 54 is pivotably disposed on holder 56, so as to be pivotable about shaft 55 (in the directions of arrows K and I). In this manner, monitoring roller 52 is disposed to be adjustably movable relative to the roller 18. The monitoring roller 52 exhibits a cover surface with a predetermined friction value. Through measurement of the transfer forces from the roller 18 to the monitoring roller 52 the friction characteristics of the roller 18 can be monitored and measured. In the embodiment according to FIG. 5 this is schematically illustrated by mechanical means. It is also contemplated by the inventor that this force can be measured electrically by means of correspondingly arranged devices at the monitoring roller 52. The end 58 of a tension band 57 is fixed at the shaft 53 of the monitoring roller 52. The other end of band 57 extends over roller 59 and is connected to a spring 60 which in turn is fastened to a rod 61. The extension of the spring 60 is in this case a measure of the transfer forces and thereby also a measure of the friction characteristics of roller 18.

It is provided that conditioning of the roller 18 is dependent upon the measured friction characteristics of the roller 18. According to the embodiment of FIG. 5, a valve 64 is arranged in the inlet to the nozzle 51 supplying coating material for the transfer roller. This valve 64 is activated by the device 65 for monitoring the friction effect. Automatic control is thereby achieved, for example, by means of the monitoring roller 52 for the roller 18. When the necessary transfer force is not measured at the monitoring roller 52, the valve 64 is opened so that a transfer of coating material to the roller 18 takes place. In FIG. 5 it is schematically depicted that the spring 60 is provided with a contacting member 62 which is arranged adjacent an end switch 63 connected in turn to the valve 64. When this switch 63 is contacted by member 62 of spring 60, the valve 64 is closed as a result of the roller 18 reaching the desired friction characteristics.

In connection with the embodiment discussed above for illustrative purposes, it is disclosed that conditioning of the roller 18 is effected by transfer of coating material. It is further contemplated that other kinds of conditioning be utilized, such as polishing or grinding of the cover surface of roller 18. It is also to be understood, in a similar manner, that not only the friction effect of the roller 18 which rotates outwardly of the wedge slot be monitored and conditioned, but also that the friction characteristics of the surface of the inwardly rotating roller 18 be monitored and conditioned.

Figure 6:
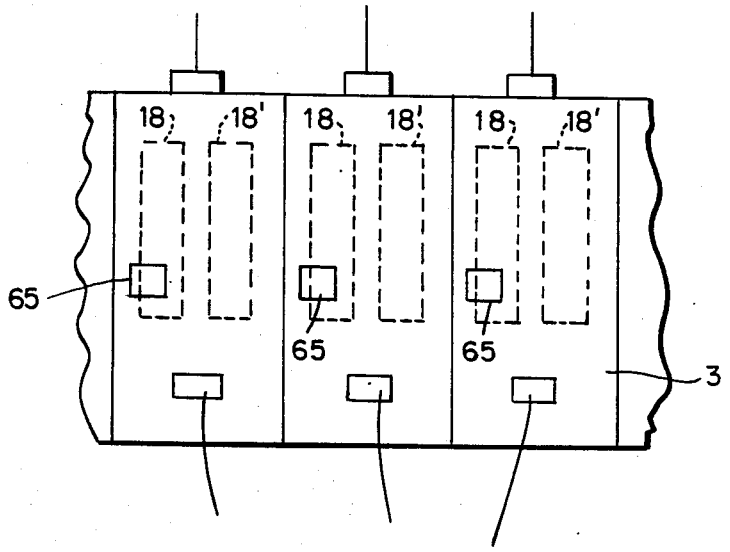
FIG. 6 is a schematic view of an open-end friction spinning machine in which each of the spinning units has a friction surface monitoring device.

As shown schematically in FIG. 6, one embodiment of the invention can include a monitoring device 65' associated with each spinning unit of the apparatus. This monitoring device is shown in more detail in FIG. 5 at 65.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. An open-end friction spinning apparatus including at least one spinning unit having a yarn formation zone adjacent drivable friction surface means comprising:

at least one friction surface conditioning means for conditioning said friction surface means, said at least one conditioning means including pivotably mounted transfer roller means adjacent said friction surface means, and friction surface monitoring means for monitoring friction characteristics of said friction surface means, said friction surface monitoring means including monitoring roller means and measuring means for measuring a frictional force applied to said monitoring roller means by said friction surface means.

2. An apparatur according to claim 1, wherein said drivable friction surface means comprises adjacently arranged first and second friction rollers driven in the same rotational direction and said yarn formation zone comprises a wedge shaped gap between said friction rollers.

3. An apparatus according to claim 1, wherein said measuring means comprises mechanical measuring means for measuring a frictional force applied to said monitoring roller means by said friction surface means.

4. An apparatus according to claim 1, wherein said conditioning means is responsive to a friction condition monitored by said monitoring means.

5. An open end friction spinning apparatus according to claim 1 further comprising adjustably movable servicing means capable of being disposed adjacent said at least one spinning unit, said friction surface monitoring means being attached to said servicing means.

6. An apparatus according to claim 1, wherein auxiliary drive means are provided for driving said friction surface means during monitoring of said friction characteristics.

7. An apparatus according to claim 1, wherein said conditioning means includes coating means for applying coating onto said surface of said friction surface means.

8. An apparatus according to claim 1, wherein a plurality of said spinning units is provided.

9. An open-end friction spinning apparatus including at least one spinning unit having a yarn formation zone adjacent drivable friction surface means comprising:

at least one friction surface conditioning means for conditioning said friction surface means, and friction surface monitoring means for monitoring friction characteristics of said friction surface means, said friction surface monitoring means including pivotably disposed monitoring roller means for engaging said friction surface means and measuring means for measuring a frictional force applied to said monitoring roller means by said friction surface means.

10. An apparatus according to claim 9, wherein said conditioning means comprises pivotable mounted transfer roller means adjacent said friction surface means.

11. An open-end friction spinning apparatus including at least one spinning unit having a yarn formation zone adjacent drivable friction surface means comprising:

at least one friction surface conditioning means for conditioning said friction surface means, and friction surface monitoring means for monitoring friction characteristics of said friction surface means, said friction surface monitoring means including monitoring roller means and measuring means for measuring a frictional force applied to said monitoring roller means by said friction surface means, said measuring means including mechanical measuring means for measuring a frictional force applied to said monitoring roller means by said friction surface means, wherein said monitoring roller means is mounted on shaft means and said mechanical measuring means comprises tension band means being fixed at one end to said shaft means, said tension band means being fixed at another end to spring means.

12. An apparatus according to claim 11, wherein said conditioning means is responsive to a friction condition monitored by said monitoring means.

13. An apparatus according to claim 11, further comprising:

contacting member means attached to said spring means, and contact switch means mounted adjacent said contacting means for activating said conditioning means, and said contacting member means being capable of contacting said contact switch means when said spring is stretched by a preselected force applied to said tension band means by said friction roller.

14. An apparatus according to claim 13, wherein said servicing means includes at least one of said friction surface conditioning means.

15. An open end friction spinning apparatus including a plurality of spinning units, each unit having a yarn formation zone adjacent drivable friction surface means comprising:

at least one friction surface conditioning means for conditioning said friction surface means, and friction surface monitoring means for monitoring friction characteristics of said friction surface means, each said spinning unit having one said friction surface monitoring means, said friction surface monitoring means including monitoring roller means and measuring means for measuring a frictional force applied to said monitoring roller means by said friction surface means.

16. An apparatus according to claim 15, further comprising signal means for generating a signal when said friction characteristics of said friction surface means are unacceptable, said signal means being responsive to said monitoring means.

17. An open-end friction spinning apparatus including at least one spinning unit having a yarn formation zone adjacent drivable friction surface means comprising:

at least one friction surface conditioning means for conditioning said friction surface means, said conditioning means including coating means for applying coating onto said surface of said friction surface means, said coating means including transfer roller means for applying said coating onto said friction surface means, said friction surface monitoring means including monitoring roller means and measuring means for measuring a frictional force applied to said monitoring roller means by said friction surface means.

18. An apparatus according to claim 17, wherein said coating means comprises spray nozzle means adjacent said transfer roller means for applying coating onto said transfer roller means.

19. An apparatus according to claim 17, wherein said friction surface means exhibits a closed cover surface and rotates adjacent said yarn formation zone during spinning operations.

20. An open-end friction spinning apparatus including at least one spinning unit having a yarn formation zone adjacent drivable friction surface means comprising:

at least one friction surface conditioning means for conditioning said friction surface means, and friction surface monitoring means for monitoring friction characteristics of said friction surface means, said friction surface monitoring means including monitoring roller means and measuring means for measuring a frictional force applied to said monitoring roller means by said friction surface means, said measuring means comprising mechancial measuring means for measuring a frictional force applied to said monitoring roller means by said friction surface means, said monitoring roller means being mounted on shaft means and said mechanical measuring means comprising tension band means fixed at one end to said shaft means, said tension band means being fixed at another end to spring means, wherein contacting member means are attached to said spring means, and contact switch means are mounted adjacent said contacting means for activating said conditioning means, said contacting member means being capable of contacting said contact switch means when said spring is stretched by a preselected force applied to said tension band means by said friction roller.

21. An apparatus according to claim 20, wherein said servicing means includes at least one of said friction surface conditioning means.

* * * * *